US007497211B2

(12) United States Patent
St. George

(10) Patent No.: US 7,497,211 B2
(45) Date of Patent: Mar. 3, 2009

(54) TRIGGER CONTROLLED RELEASE OF CONTROLLED NUMBERS OF PROJECTILES AT EACH OF CONTROLLED NUMBER OF INSTANCES PER REVOLUTION IN A CENTRIFUGAL PROPULSION WEAPON

(76) Inventor: Charles St. George, 401 Second Ave., Murfreesboro, TN (US) 37130

( * ) Notice: Subject to any disclaimer, the term of this patent is extended or adjusted under 35 U.S.C. 154(b) by 475 days.

(21) Appl. No.: 11/283,445

(22) Filed: Nov. 18, 2005

(65) Prior Publication Data

US 2008/0092866 A1 Apr. 24, 2008

(51) Int. Cl.
*F41B 3/04* (2006.01)

(52) U.S. Cl. ..... 124/6

(58) Field of Classification Search ..... 124/4, 124/6, 31

See application file for complete search history.

(56) References Cited

U.S. PATENT DOCUMENTS

| | | | | | |
|---|---|---|---|---|---|
| 1,783,053 | A | * | 11/1930 | Baden-Powell | 124/6 |
| 3,585,978 | A | * | 6/1971 | Hurlimann | 124/6 |
| 3,822,688 | A | * | 7/1974 | Mayne | 124/6 |
| 4,471,746 | A | * | 9/1984 | Ando | 124/6 |
| 5,857,451 | A | * | 1/1999 | Ciluffo et al. | 124/6 |

* cited by examiner

*Primary Examiner*—John A. Ricci

(74) *Attorney, Agent, or Firm*—Intellectual Property Center, LLC; Arthur K. Shaffer

(57) ABSTRACT

A weapon 1 peripherally discharging projectiles 2*a*-2*n*, normally ball bearings, at sustained high rates under centrifugal force has at least one member 11 rotating within a housing, or guide track, 10. Each rotating member 11 has at least one channel, or track, 16 with a radial component within which projectiles 2*a*-2*n* received near the center of rotation progress radially outwards until first escaping at 19, and then being ejected at X, under centrifugal force at the periphery of the at least one rotating member 11. A projectile release mechanism controls the timing, locations, and numbers of projectiles released per rotation of the at least one rotating member. This mechanism uses (1) an elongate member 13, substantially positioned along a radius line and within the at least one member 11 with its distal end protruding within the at least one channel 16 and with a proximal end cam follower 13 contacting the interior circumference 181 of (2) a ring cam 18, non-rotating to the housing 10 and movable between positions both coaxial, and displaced, to the rotational axis of the at least one rotating member 11. The elongate arm 13 moves (1) radially outward under centrifugal force of the rotation of the at least one rotating member 11 until its distal end protrudes within the at least one channel 16, therein obstructing passage of projectiles 2*a*-2*n* along the channel 16 and any ejection of these projectiles 2*a*-2*n* from the periphery of the at least one rotating member 11, until (2) the cam follower 14 of the elongate arm 13 contacts during rotation the cam 181 surface of the ring cam 18, pulling the elongate arm 13 against centrifugal force radially inwards until its distal end ceases to protrude within the channel 16, losing passage of projectiles 2*a*-2*n* along the channel 16 for subsequent escape at 19 and for ejection at X.

14 Claims, 9 Drawing Sheets

TRIGGER CONTROLLED RELEASE OF CONTROLLED NUMBERS OF PROJECTILES AT EACH OF CONTROLLED NUMBER OF INSTANCES PER REVOLUTION IN A CENTRIFUGAL PROPULSION WEAPON

REFERENCE TO A RELATED APPLICATION

The present application claims benefit of priority of Australian Provisional Patent Application No. 2004906627, filed 19 Nov. 2004, to the selfsame inventor as is the present patent application

BACKGROUND OF THE INVENTION

1. Field of the Invention

The present invention generally relates to automatic weapons using centrifugal force to propel projectiles.

The present invention particularly relates to projectile trigger and release mechanisms for rotating weapons propelling projectiles by centrifugal force.

The present invention still more particularly relates to control of each of (1) the release of projectiles, (2) the numbers of projectiles released, and (3) the numbers of instances per revolution at which projectiles may selectively be released, in a rotating weapon propelling projectiles by centrifugal force.

2. Background of the Invention

2.1 A SPECIFIC PRIOR PATENT

The present invention is related to the inventor's own prior invention of a Weapon for centrifugal propulsion of projectiles that is the subject of U.S. Pat. No. 6,520,169, issued Feb. 18, 2003.

That patent teaches a weapon for centrifugally discharging projectiles at a rapid rate having a housing in which is mounted a rotating disc having a multiplicity of feed channels extending radially therein. Each of the feed channels receives a number of projectiles and is configured to orient the projectiles in a single file adjacent the periphery of the rotating disc. The weapon of the present invention will likewise be seen to have (1) a housing, (2) one or more feed channels within a rotating disc or, in the present invention, one or more rotating arms.

In the previous device, and patent, a locking means consisting of a multiplicity of stops held the projectiles that were within each of the feed channels, selectively releasing the projectiles. Namely, each of the stops was movable between (1) a first position within the channel to preclude movement of the outermost projectile outwardly of the channel and (2) a second position removed from the channel to permit movement of a projectile within the channel. Locking cams served to move the stops between the first and second positions. Another cam actuated the locking cams as the disc was rotated in order to move the outermost stop into the second position so as to release the outermost projectile, the adjacent stop meanwhile restraining the adjacent projectile which is only thereafter released to move outwardly until restrained by the first stop. In this manner projectiles were "gated" for ejection, The weapon of the present invention will be seen to be considerably changed in this area involving the selective release, or ejection, of the projectiles. The previous locking means consisted of a number of stops that moved orthogonally to the plane of the rotating disc. This is now entirely replaced by a new mechanism now called a "selector timer", which mechanism operates entirely within the plane of the rotating disk (or rotating arm(s)). These "selector timers", one for each channel, will be seen to be operated by cams which are now robust in construction, and are themselves again within the rotating plane of the disk (or arm(s)). Consonant with the fact that a "selector timer" mechanism may sound more sophisticated than does a "locking means", or a reciprocating "stop", the mechanism of the present invention will be seen to be quite versatile, and precise, in controlling each, and any, of (1) the instances, (2) the numbers of instances, per revolution, and (3) the numbers of projectiles, that are selectively ejected by a rotating weapon propelling projectiles by centrifugal force.

Finally, in the previous weapon for centrifugal propulsion of projectiles the projectiles were selectively released into a guide rail extending substantially about the periphery of the disc, with this guide having a discharge opening therein. Such a guide will be seen to still exist in the centrifugal propulsion weapon of the present invention.

2.2 GENERAL BACKGROUND OF THE INVENTION

As explained in the related predecessor patent, a gradual evolution in small caliber weapons development has occurred over the last 20 years with the emphasis being towards high rates of fire, saturation fire in the general direction of the perceived enemy position and the ever increasing awareness of the need to ensure the weapon crew survivability during missions. Prolonged saturation fire exposes the weapon crew to return fire from the enemy who can detect the position from which fire is received.

Weapons that use centrifugal force instead of an explosive powder propellant for launching the projectiles have been known in the prior art. One type of centrifugally operated gun involves straight radially extending barrels such as those shown in U.S. Pat. No. 1,472,080 to McNaier and U.S. Pat. No. 3,177,862 to Allemann. A limitation of such a construction is that the power required to rotate the radial barrel is too great to develop an economically feasible rapid fire weapon. In U.S. Pat. No. 3,177,862 to Allemann, radial gun barrels are incorporated within the helicopter blades which would slow down the speed of rotation of the blades due the absorption of energy by the projectile as the projectiles pass through the barrels.

Another type of centrifugal gun includes a gun barrel having an arcuate rather than a radial construction. Such construction has, however, limited the speed of the projectiles for various reasons including (1) rotation of the bullet in a direction reverse to travel direction of the projectile and (2) the provision of a peripheral barrier which prevents emission of the projectile at the precise moment that it achieves its maximum speed at the exit end of the barrel. Illustrative of such weapons are those of Brown in U.S. Pat. No. 1,240,815, of Blair in U.S. Pat. No. 1,284,999, of Parsons in U.S. Pat. No. 1,408,137 and of Baden-Powell in U.S. Pat. No. 1,662,629.

Associated with the foregoing type of gun has been the problem of overcoming the strong gyroscopic reaction force of a rotating impeller that resists turning and moving a gun when aiming in a plane that is not perpendicular to the axis of rotation of the impeller. One solution proposed in U.S. Pat. No. 3,613,655 to Tobin is to provide a first impeller which rotates clockwise to offset the second impeller which rotates counterclockwise and thereby nullify the gyroscopic reaction. Most prior art weapons have relied upon gravity feed of the projectiles through a hopper design with some form of screw device to aid projectile movement into desired channels or barrels. Such gravity feed loading systems are not able to feed the desired amount of projectiles in any centrifugal operated weapon at high speeds since the rotating member that provides the centrifugal force to propel the projectiles expels the projectiles much faster than any gravity feed loading system can supply. Thus, the rate of fire of these weapons is restricted by having the rate of fire controlled by gravity fed loading systems.

2.3 OBJECTIVES OF THE PRESENT INVENTION

It is an object of the present invention, as it was of the Inventor's previous invention, to provide a novel automatic weapon utilizing centrifugal force which provides both a high rate of discharge (rounds per minute) and high muzzle velocity.

It likewise remains an object to provide such an automatic weapon which operates in a continuous stealth mode to increase its operational capabilities and the survivability of the weapon crew.

It likewise remains a further object to provide such a weapon which effectively eliminates overheating, jamming, the need for synchronized feeding and peripheral discharge, and any requirement for mechanical compensation for possible gyroscopic reaction.

It likewise remains a still further object to provide such a weapon which has the capability of firing thousands of rounds per minute at high velocities with a continuous supply of projectiles and without the need for feed to fire synchronization, and without incorporating some form of gyroscopic control system and some form of balancing device.

It is a still further particular object of the present invention that any of the of (1) instances of the release of projectiles, (2) the numbers of projectiles released per instance, and (3) the numbers of instances per revolution at which projectiles may selectively be released, should be easily, positively, exactingly and reliably controllable.

It is yet a still further a particular object of the present invention to produce a centrifugal weapon where the velocity, and rate, of projectile ejection is continuously variably controllable in a range extending from zero velocity and rate to a maximum velocity of many hundreds of feet per second, and a maximum rate of several thousands of ejected projectiles per minute. This is quite unlike a conventional propellant-based automatic weapon where a minimum amount of propellant must typically be used to reliably activate the mechanism of the weapon while propellant of less than some maximum amount must be used to accommodate the maximum operational cycle speed of the same mechanism.

SUMMARY OF THE INVENTION

The present invention contemplates a positive-acting projectile release mechanism for a weapon peripherally ejecting projectiles under centrifugal force. For each rotation of a rotating member of the weapon, each of (1) the number of different channels, or instances, at and from which projectiles are released, (2) the number of times that projectiles are released (ejected) from each channel, and even (3) the number of projectiles released each time from each channel, may be variably predetermined, and to some extent may be variably controlled. High rates of projectile ejection are reliably realized. For example, some 2,000 spherical steel projectiles of 0.308 inch diameter and may typically be ejected at a velocity of 800 to 3000 feet per second each minute on either a continuously sustained basis or in bursts.

The present invention further contemplates a centrifugal weapon where the velocity, and the rate, of projectile ejection is continuously variably controllable in a range extending from zero velocity and rate to a maximum velocity of many hundreds of feet per second, and a maximum rate of several thousands of ejected projectiles per minute. The weapon is continuously variably operative throughout this range, normally by the simple expedient of speeding up, or slowing, the rotation of an electric motor which powers a rotating member from which, and by which, the projectiles are ultimately ejected. The positive-acting projectile release mechanism remains reliably operational throughout this range, and is not negatively effected by any variation in the ejection cycle time of the weapon.

1. A Projectile Release Mechanism for a Weapon for Peripherally Discharging Projectiles Under Centrifugal Force Accordingly, in one or its aspects the present invention is embodied in a projectile release mechanism for use in a weapon for peripherally discharging projectiles under centrifugal force.

Such a weapon has (1) a peripheral housing or guide track having an opening through which projectiles may be ejected, (2) at least one member a disc or an arm—rotating within the housing, and (3) at least one channel, having a radial component, located within the at least one rotating member. Projectiles received into this at least one channel near the center of rotation progress radially outwards until ejected under centrifugal force of the at least one rotating member at the opening of the peripheral housing, or guide track.

In this weapon one or more projectile release mechanisms in accordance with the present invention serve to control release of the projectiles. The preferred projectile release mechanism interacts with each rotating member—the rotating disc or, equivalently, the one or more rotating elongate arms, as are described above. More particularly, the preferred mechanism acts within the channels, and with the projectiles contained within these channels, of each rotating member (the rotating disk or rotating arm(s)) so as to control, or "gate", the ejection of these projectiles from the weapon.

The projectile release mechanism includes an elongate linear member, normally in the form of a simple rod, that is normally positioned substantially along a radius line and within a rotating member (the rotating disc, or a rotating arm). This elongate linear member has (1) a distal end protruding within the at least one channel and (2) a proximal end cam follower. The elongate member, or rod, moves radially outward under centrifugal force of the rotation of the rotating member (the disc, or a rotating arm) until its distal end protrudes within the channel of the member, therein obstructing passage of projectiles along the channel and blocking any ejection of projectiles from the periphery of the at least one rotating member The projectile release mechanism also includes a ring cam, stationary to the housing and substantially centered to the rotational axis of the rotating member (the rotating disc, or a rotating arm). The interior circumference of this ring cam contacts the proximal end of the cam follower. When this ring cam is eccentrically moved, as is preferred when releasing the projectiles, the cam follower of the elongate member, or rod, will move this elongate member, or rod, radially during the course of rotation.

Thus a sliding contact between the cam surface of the ring cam and the cam follower of the elongate arm, or rod, during rotation of rotating member serves to pull the elongate member against centrifugal force radially inwards until the distal end of the elongate arm ceases to protrude within the channel sufficiently so as to obstruct any passage of projectiles along the channel. By this action one or more projectiles are permitted to pass radially outwards in the at least one channel for subsequent ejection.

The cam surface of the ring cam acting on the cam follower of the elongate arm, or rod, may serve to gate passage of but one projectile within the channel of the at rotating member, and ejection of this single projectile, but once each rotation of the rotating member of the weapon. However, the cam surface of the ring cam may alternatively act on the cam follower of the elongate arm to gate passage of a plurality of projectiles within the channel of the at least one rotating member, and ejection of this plurality of projectiles, each rotation of the rotating member of the weapon.

Consider now when the ring cam is concentrically mounted to the rotating member (the rotating disk, or a rotating arm). If the camming surface (the interior diameter) of the ring cam presents a plurality of raised areas, then a camming movement of the elongate member, or rod, can gate passage within an associated channel, and subsequent ejection from the weapon, of one or more projectiles upon each of a plurality of times each rotation.

Finally, it may be considered that a rotating member in the form a rotating disc may have multiple channels, each with its associated projectile timer release mechanism. Equivalently, the rotating member may consist of multiple rotating arms, each with its own associated projectile timer release mechanism. Clearly a greater number of projectile channels holds the possibility of releasing more projectiles per rotation.

Accordingly, the number of different channels, or instances, at and from which projectiles are released each rotation may be controlled. Moreover, the number of times that projectiles are released (ejected) from each channel may be controlled. Finally, the number of projectiles released each time may be controlled. Release, or ejection, control or projectiles is really quite exquisite, and extends to far more than just numbers and rates. For example, research with ballistic weapons has established the utility of sometimes sending more than one, and some two or three bullets, towards without going into a sustained fuselage, or avalanche, or cascade, of continuous fire. The projectile release mechanism of the present invention readily permits, for example, that two projectiles might be released (ejected), followed by a pause, followed by the release (ejection) of two more projectiles, and so on. The weapon preferably, and most commonly does, use a disc with several channels or, equivalently, several rotating members each with an associated channel. There are then a like number of projectile release mechanisms, one release mechanism for each channel. The cam follower of the elongate member, or rod, or each release mechanism is then acted upon in turn by a same cam surface of the ring cam so as to gate passage of one or more projectiles within the channel of the associated rotating member, and the ejection of these one or more projectiles, upon each rotation of the rotating member of the weapon.

The at least one rotating member and its associated one or more channels, and its associated projectile release mechanism consisting of the elongate member with its cam follower, and also of the ring cam, are all substantially in the same plane.

The weapon may use an electric motor rotating the at least one rotating member. A control for the motor permits varying the rotational force, and the corresponding rate at which projectiles are expelled, and their expulsion velocity.

2. A Method of Gating Passage of Projectiles within a Channel within a Rotating Member of a Weapon Ejecting the Projectiles by Centrifugal Force In another of its aspects the present invention is embodied in a method of gating passage of projectiles within a channel within a rotating member of a weapon ejecting the projectiles by centrifugal force. The gating method is directed to controlling the ejection of the projectiles.

The preferred method includes locating a sliding member within a plane of the rotating member for sliding between (1) a first position obstructing any passage of projectiles within the channel under centrifugal force, and any subsequent expelling of projectiles, and (2) a second position withdrawn from obstructing the channel of the rotating member, permitting projectiles to pass along the channel under centrifugal force and a subsequent ejection of projectiles so passed from and by the weapon.

The sliding member preferably assumes its first position under centrifugal force.

The sliding member preferably assumes its second position under a camming force.

3. A Centrifugal Weapon where the Velocity, and Rate, of Projectile Election is Continuously Variably Controllable In still yet another of its aspects the present invention is embodied in a centrifugal weapon where the velocity, and rate, of projectile ejection is continuously variably controllable.

The weapon includes a variable speed rotational prime mover imparting rotational force.

A member driven in rotation by the prime mover. This rotating member has at least one channel in which a projectile may move outwardly from a feed position near a center of rotation to an escape position at the periphery of the rotating member.

A housing, or track, guides projectiles escaping at the periphery of the rotating member so that the projectiles are ejected from the weapon at a predetermined exit point.

Finally, a projectile release mechanism controls passage of projectiles within the at least one channel of the rotating member, and thus the escape of these projectiles from the periphery of the rotating member, and thus the ejection of these projectiles from the weapon. This projectile release mechanism is continuously so functional for controlling passage of the projectiles when the rotational speed and force of the prime mover is varied in a range between (1) essentially zero, where but few projectiles infrequently dribble from the weapon with essentially zero ejection velocity, and (2) a high rate of speed where multiplicities of more than 10 projectiles each minute are ejected from the weapon at speeds greater than 100 feet per second;

Accordingly, both a velocity, and a rate, of projectile ejection from the weapon are continuously variable with change in the rotational speed of the prime mover.

The prime mover preferably consist of an electric motor.

The preferred projectile release mechanism is as before, including (1) an elongate member moving radially outward under centrifugal force of the rotation of the at least one rotating member until its distal end protrudes within the at least one channel, therein obstructing passage of projectiles along the channel and any escape of projectiles from the periphery of the at least one rotating member, and (2) a ring cam, stationary to the housing and with its center displaced from a rotational axis of the at least one rotating member, having a cam surface that, when contacted during rotation by the cam follower of the elongate member, acts to pull the elongate member against centrifugal force radially inwards until the distal end of the elongate member ceases to protrude within the channel sufficiently so as to obstruct any passage of projectiles along the channel, therein permitting one or more projectiles to pass radially outwards in the at least one channel for subsequent escape from the at least one rotating member, and for subsequent ejection from the weapon.

These and other aspects and attributes of the invention will become increasingly clear upon reference to the following drawings and associated specification.

BRIEF DESCRIPTION OF THE DRAWINGS

Referring particularly to the drawings for the purpose of illustration only and not to limit the scope of the invention in any way, these illustrations follow.

DESCRIPTION OF THE PREFERRED EMBODIMENT

The following description is of the best mode presently contemplated for the carrying out of the invention. This description is made for the purpose of illustrating the general principles of the invention, and is not to be taken in a limiting sense. The scope of the invention is best determined by reference to the appended claims.

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

1. GENERAL OPERATION AND PRINCIPLES OF THE INVENTION

In accordance with the present invention an electrically operated weapon uses electrical energy for both the weapon's operation and the launching of projectiles by rotating a member at high revolutions per second to generate high centrifugal forces. A large number of projectiles may be launched per unit time at very high velocities. The present invention particularly concerns a projectile release mechanism for use in a weapon for peripherally discharging projectiles under centrifugal force. Such a weapon is shown in issued U.S. Pat. No. 6,520,169, for a weapon for Centrifugal Propulsion of Projectiles to the selfsame inventor as is the present invention. The contents of the related predecessor patent application are incorporated herein by reference.

Figure 1:
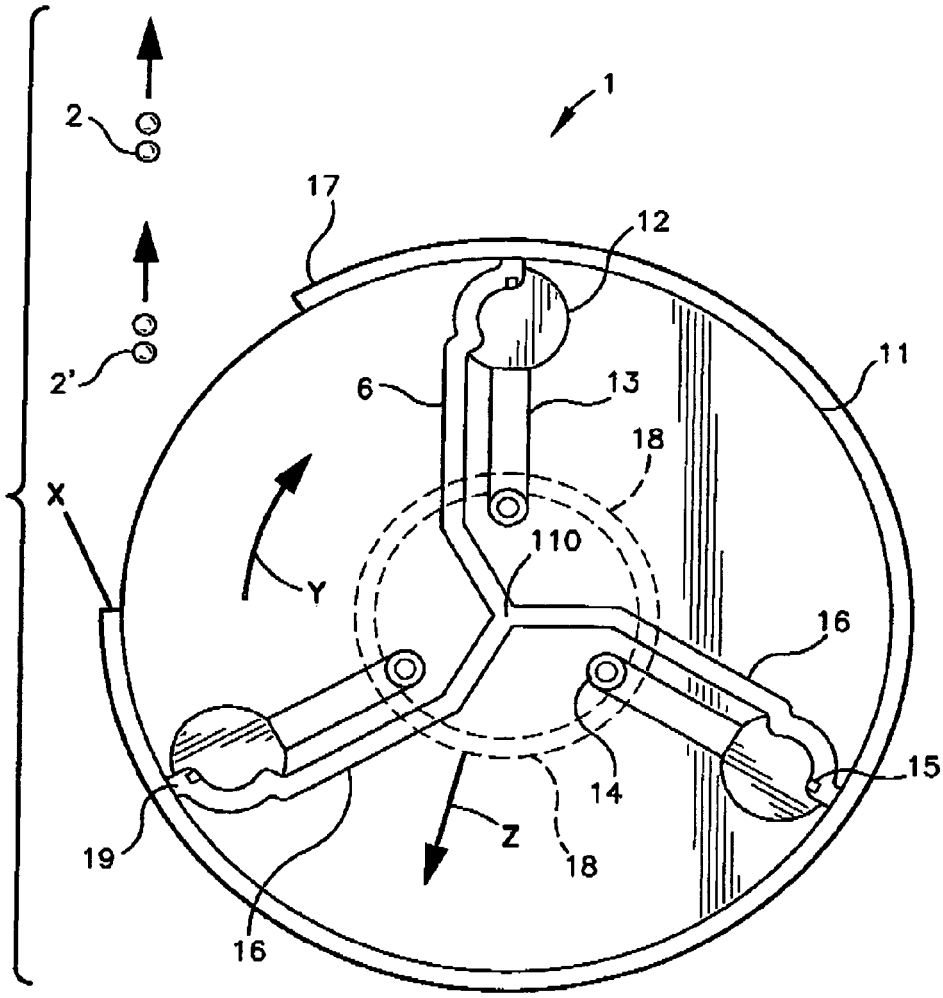
FIG. 1 is top plan view of a weapon having a projectile release mechanism in accordance with the present invention in use for ejecting projectiles, by way of illustration in burst of six projectiles each burst.

Referring to FIG. 1, there is shown a plan view of a weapon 1 having a rotating member 11 with release areas 19 which permit the release of projectiles 2 and 2' (shown ejected in FIG. 1, shown still within the weapon 1 in FIGS. 2-5) which have been held within housing, or guide track, 11 until reaching under rotation Y the release point X. In accordance with the present invention, projectiles 2 and 2' FIG. 1 were gated for this release by action of a projectile release mechanism consisting of an elongate, linear, member, or rod, 15 which has been actuated and moved in position in a radial direction typified by arrow Z by action of ring cam 18.

The linear member, or rod, 15 both loads and releases the projectiles 2, 2' periodically with rotation of the rotating member 1 by cyclically assuming (when the weapon 1 is activated for projectile ejection by movement of ring cam 18, as will be later explained) each of two pre-determined positions. One, radially withdrawn, position ultimately permits the projectiles 2, 2' to depart at point X the confinement provided by outer housing, or ring, or guide track 17. These projectiles 2, 2' depart the weapon 1 in a straight line, as illustrated, normally with one projectile 2 being gated by elongate linear member, or rod 15 into a release area 19 (of which three such are shown in FIG. 1) for each revolution of rotating member 11.

In the example shown in this invention there are three (3) release areas 19 and, if but one projectile 2*a*-2*n* (reference FIG. 2) is gated into each release area 19 per revolution, only three projectiles are released per revolution. For example, if the rotating member 11 rotates at 1000 revolutions per second, the rotating member will release 3000 projectiles per second. Conversely, of two such projectiles were to be gated into each release area 19 per revolution, then the pattern of the flight of the projectiles in space would resemble that of moving projectiles 2, 2' as illustrated in FIG. 1.

Centrifugal force is the basis of projectile propulsion in this and related inventions. Use of conventional powder propellants is eliminated. This permits the deployment of a weapon that is completely jam proof, does not generate any heat, or blast and is completely safe for the environment since it also eliminates lead toxic projectiles. Most normally, steel ball bearings of 0.308 inch diameter (corresponding to .308 caliber bullets) are used as projectiles, although the weapon may easily vary in size to accommodate projectiles from 0.1 to 1 inch. One significant aspect of the present and related invention is that the weapon 1 does not exhibit any recoil as is common with weapons that utilize exploding powder propellants. The opposite force to the ejection (per Newton's laws)

is taken up in the rotating mass of the rotating member 11 and most commonly, an electric motor (not shown) used to drive this member 11 in rotation. The present and related inventions therefore permit deployment in areas such as in space in a geostationary orbit, which would otherwise be impossible with conventional weapons using exploding powder propellants.

The weapon using centrifugal propulsion for projectiles in accordance with the present and related inventions may be compared to conventional weapons that fire conventional ammunition at high rates of fire through either a single barrel or multiple barrels such as Vulcan type Mini-Guns.

Due to the explosive nature of the powder propellants these weapons cannot provide sustained fire due to the heat generated which results in weapon stoppages, jams and failures. Further, these weapons carry only a limited amount of munitions due to their bulk size in nature. These limitations are substantially obviated by the centrifugal weapon of the present and related inventions.

Finally, in confined spaces conventional weapons are hazardous to their operators. One object of the present and related inventions is to eliminate these limitations, problems and hazardous effects and introduce capabilities and tactical roles previously unachievable. It is a further object to introduce a technology of improved operational safety and greater reliability than is presently possible with conventional weapons firing conventional munitions. The complete elimination of exploding powder propellants in weapons of the present design provides for the first time ever a weapon system that is totally undetectable due to its silent operation, improving likelihood of combat mission success.

2. DETAILS OF CONSTRUCTION

FIG. 1 shows a basic rotating member in the form of a disc 11 which provides projectile loading ball tracks, or channels, 16. The disc 11 may alternatively be replaced by one or more rotating arms—normally two, three or four such arms at equiangular separation.

FIG. 1 shows three ball tracks, or channels, numbered 16. As the rotating member—illustrated to be a disc—11 rotates in the direction of arrow Y, the projectiles 2*a*-2*n* shown in FIG. 2 as round spheres, or balls, are directed towards the exit point, or cavity, 19 of the rotating member 11 by the centrifugal force resulting from the rotation of the rotating member 11.

Figure 2:
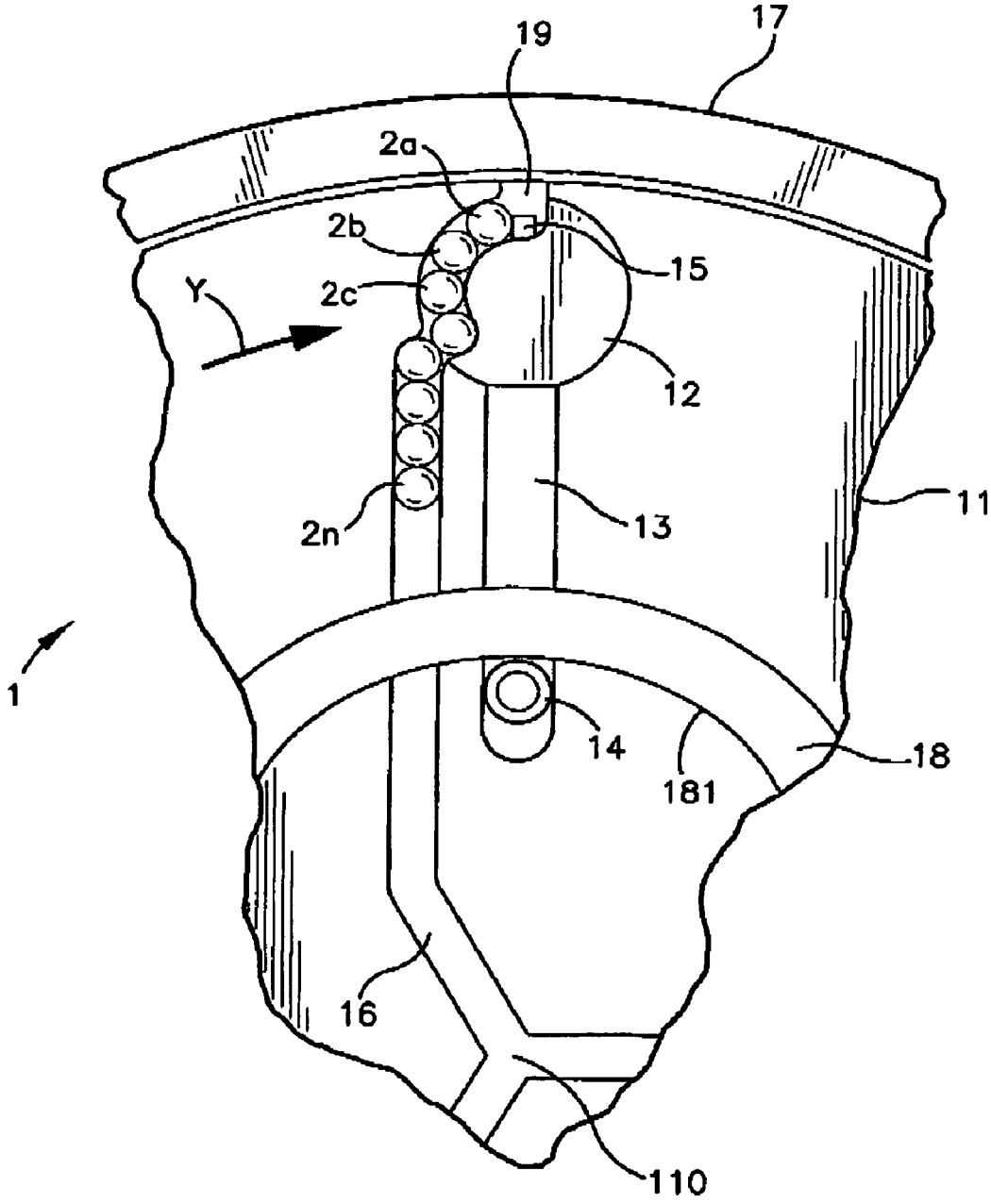
FIG. 2 is a detail top plan view at expanded scale of the projectile release mechanism in accordance with the present invention at a first time and in a first, projectile-ejection-obstructing, position.
Figure 6:
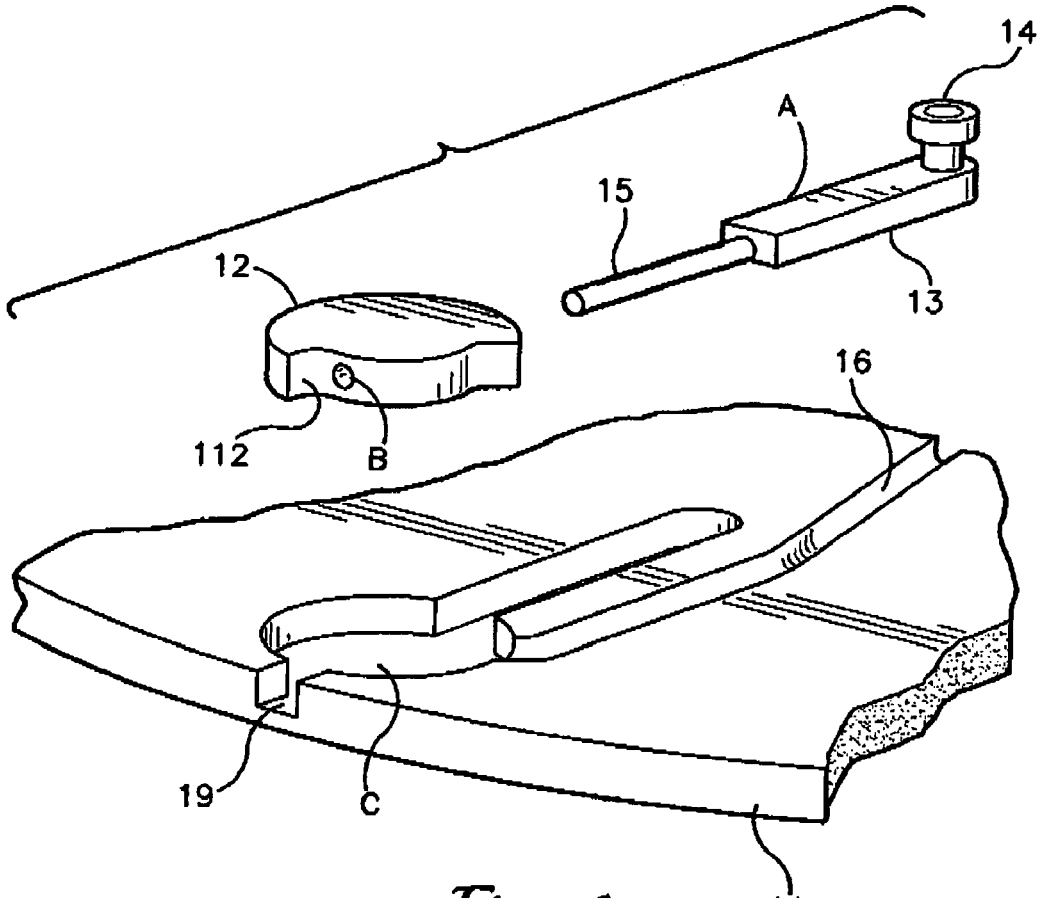
FIG. 6 is a perspective view at expanded scale of the projectile release mechanism in accordance with the present invention.

Referring to FIGS. 2 and 6, the balls 2*a*-2*n* are prevented from departing the rotating member, or disc, 11 by the elongate member, or rod, 15. This linear elongate member, or rod, 15 is a first part of a projectile release, or gating, mechanism in which a ring cam 18 is the second part. This elongate member, or rod, 15 is first held in the position shown in FIG. 2 where it prevents the first projectile, or ball, 2*a*, and behind it all other projectiles (balls) 2*b*-2*n*, from moving into release area 19 of rotating member (disc) 11 where it would be free to press up against housing, or guide track, 17 and to ultimately depart the rotating member (disc) 11 at exit X.

Still referring to FIGS. 2 and 6, the elongate linear member, or rod, 15 is attaches by known means to an elongate member selector 13 (best seen in FIG. 6) which perpendicularly attaches a cam follower in the form of roller 14. The entire elongate member, or rod 15 with its selector 13 its roller cam follower 14 are all radially urged to an outward position by centrifugal force resultant from the rotation of the rotating member, or disc, 11. FIG. 6 gives the clearest view of the preferred assembly configuration of rod 15 with its selector 13 and its cam follower roller 14. The outward, or distal, end of the rod 15 is able to prevent the projectiles, or balls, 2*a*-2*n* from departing the rotating member (disc) 11 regardless of the rotational speed of the rotating member (disc) 11 and the number of balls 2*a*-2*n* present in ball track, or channel, 16.

Figure 8:
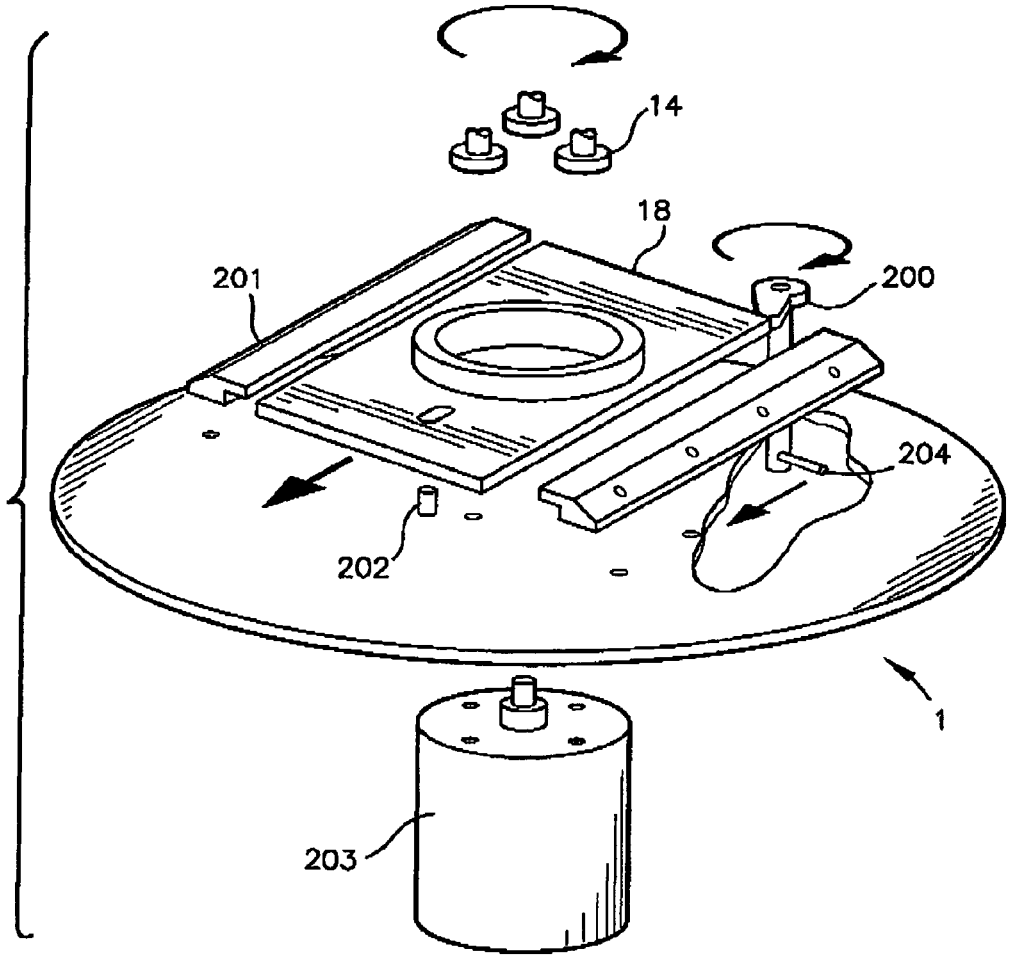
FIG. 8 is a perspective view showing a drive motor, and a mechanism by which a ring cam 18 is displaced for enabling projectile ejection, within the most preferred embodiment of the present invention.

A unique feature of the projectile release mechanism of the present invention, and the cooperative interaction of its parts, will now be described. There is provided a ring cam 18, shown in FIG. 1, that is held non-rotating by known means. The center of this circular ring cam may, however, assume positions both (1) coaxial to, and (2) displaced from, the rotational axis of rotating member 11. (The mechanism for so doing is shown in FIG. 8.)

This ring cam 18 is always positioned so that the inside of ring cam 18 faces the outer portion of the roller(s) 14 (of which there are three such present in this example drawing FIG. 1. FIG. 1 shows ring cam 18 positioned in the center of housing 1. Displacing the cam ring 18 to the direction of arrow Z—which is intended to show the directional relationship of the movement of ring cam 18 and its positional relationship to outer guide rail 17—permits that the linear elongate member, or rod, 15 should be pulled inward to its position shown in FIG. 3. The dashed line indicates how the ring cam 18 has moved eccentrically. (The ring cam 18 does not change size.)

This sequence or movement of the ring cam 18 and, responsively thereto, the linear elongate member(s), or rod(s), 15 permits the projectiles 2*a*-2*n* to be gated to release area 19. This sequence is shown in FIGS. 2-5. Then, a released, or escaped, projectile, or ball, 2*a* being held within the release area 19 by the housing, or guide track, or guide rail 17, it will ultimately depart the confinement at point X (shown in FIG. 1).

The ball guide 12 as is particularly shown in detail in FIGS. 1 and 6 is normally so configured as an insert into the rotating member, or disc, 111 for ease of machining. This ball guide 12 provides the necessary precision curve that allows a "head" projectile, or ball, 2*a*-2*n* in line—illustrated as ball 2*a* in FIG. 2—to assume position ready to be released. Once the concentically mounted ring cam 18 is actuated by movement in direction of arrow Z, then this ring cam 18 causes the withdrawal of cam follower roller 14 towards the center 110. Regard FIGS. 1 and 2. The ball 2*a* moves into position 19.

Figure 3:
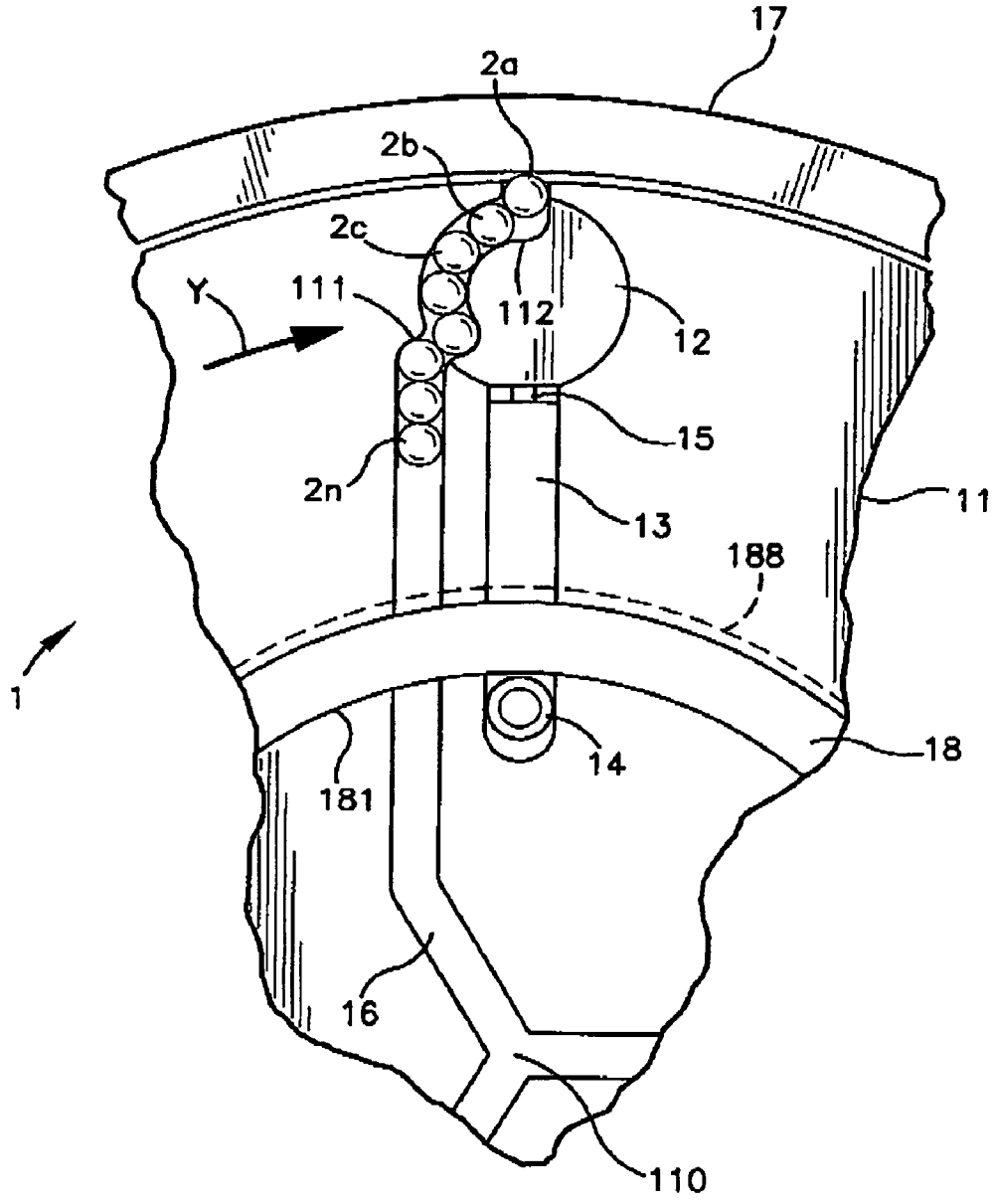
FIG. 3 is a detail top plan view at expanded scale of the projectile release mechanism in accordance with the present invention at a second time and in a second, projectile-ejection-enabling, position.
Figure 4:
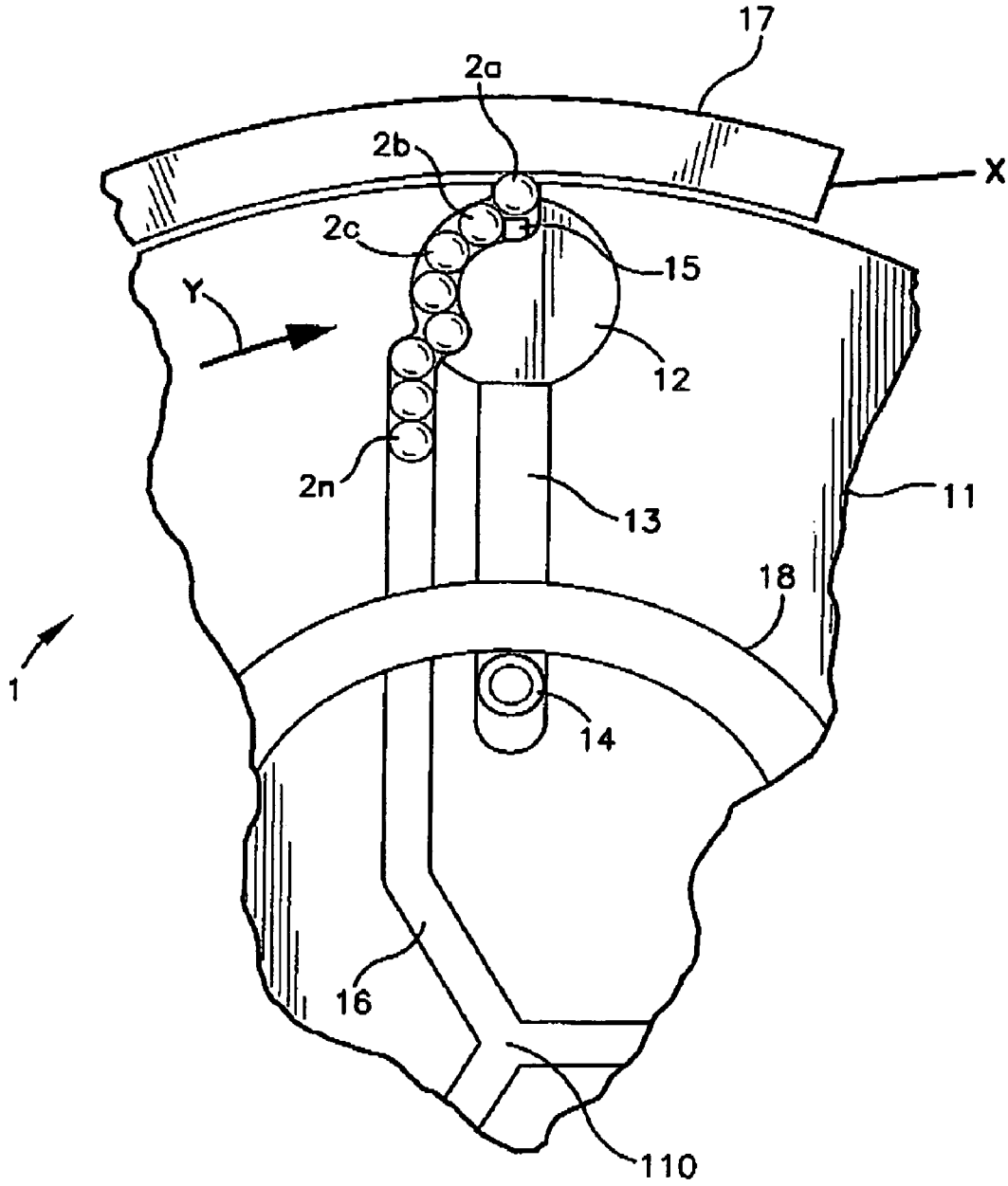
FIG. 4 is a detail top plan view at expanded scale of the projectile release mechanism in accordance with the present invention at a third time and in a third, projectile-ejection-obstructing, position with a previously gated projectile still pending ejection.

FIGS. 2 and 3 show the ball 2*a* now occupying position 19, as is still further shown in FIG. 4. FIG. 3 shows the cam ring 18 retracting (FIG. 3 shows previous position of cam ring 18 prior to actuation in direction of arrow Z FIG. 1). The selector 13 of the linear elongate member, or rod, 15 acts only but for a small portion of the rotation and prior to projectile, or ball, 2*a* being released at exit point X of the housing, or guide rail, 17.

FIG. 4 shows that linear elongate member, or rod, 15 has returned to its forward position now preventing ball 2*b* from moving into area 19.

Figure 5:
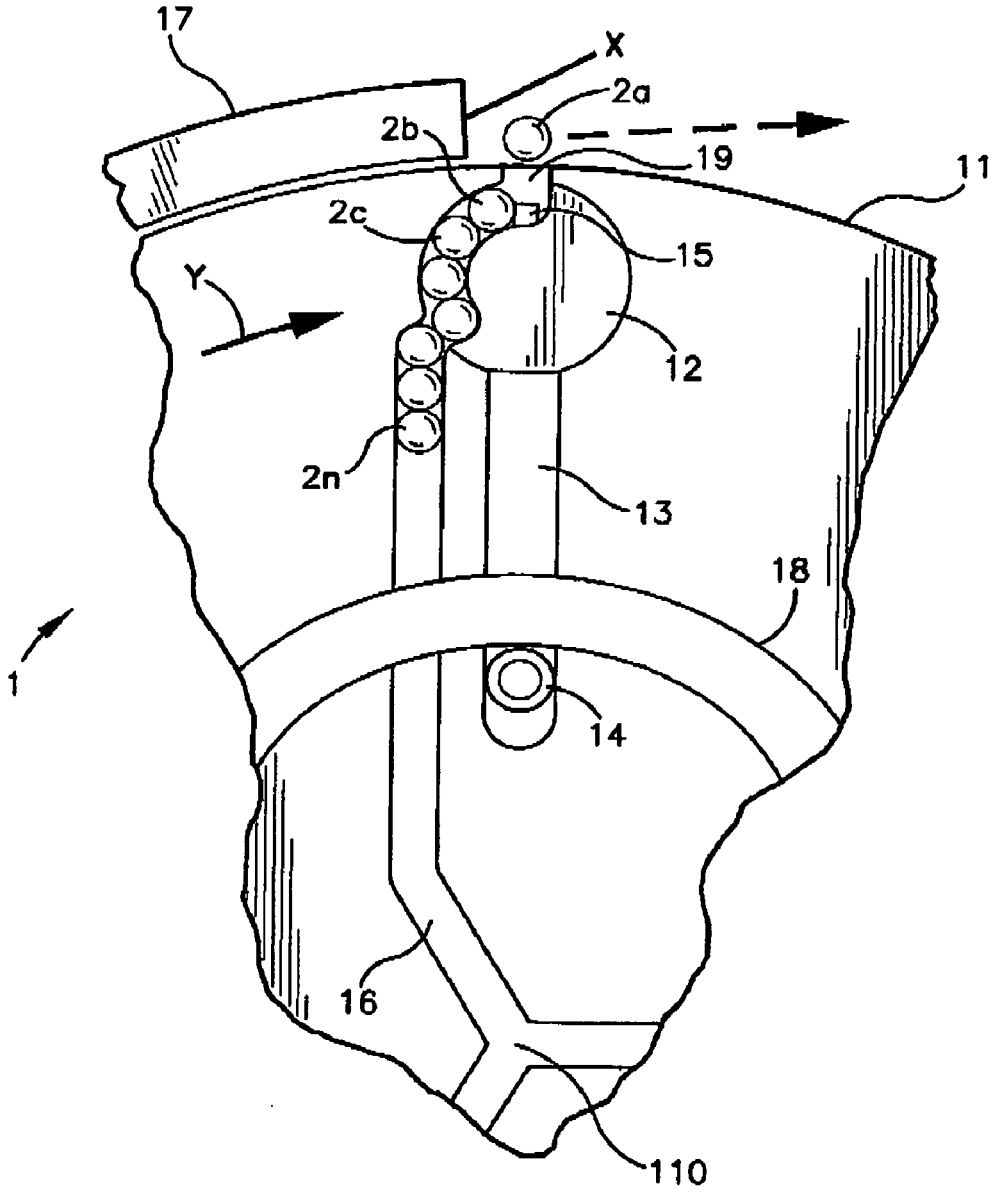
FIG. 5 is a detail top plan view at expanded scale of the projectile release mechanism in accordance with the present invention at a fourth time and still in the third, projectile-ejection-obstructing, position but with the previously gated projectile now being ejected.

FIG. 5 shows how the mechanism permits ball 2*a* to be precisely released at point X. The release of one ball per revolution per channel 16 of the rotating disc 11 has thus been sequentially illustrated in FIGS. 2-5.

Another object of this invention is to provide a mechanical release system that releases the balls precisely at a given point consistently and therefore allows the determination of the impact point onto a target. FIGS. 2-4 show ball 2*a* having been moved to and occupying position 19 as is finally shown in FIG. 4. Further, FIG. 4 also shows the housing, or guide rail, 17 holding ball 2*a* in a pre-determined position. This predetermined position of ball 2*a* holds ball 2*b* in place and so on. In this manner the subsequent ball 2*b* will not impede movement of linear elongate member, or rod, 15 and will permit this elongate member 15 to readily move back into forward position once the cam follower roller 14 has escaped the offset portion of the ring cam 18.

FIG. 3 again shows this action of the housing, or guide rail, 17 to hold ball 2*a* in a position that in turn holds ball 2*b* so as to permit the elongate member, or rod, 15 to go forward under the influence of the centrifugal forces once it is out of the confines of the offset ring cam 18.

FIG. 4 shows ball 2*a* ready to depart. It does so in FIG. 5. Meanwhile the elongate member, or rod, 15 prevents ball 2*b* from moving into position 19. Further rotation of disc 11 will permit this ball 2*b* to move into position 19 and to be subsequently released during the next revolution of disc 11.

This sequence repeats itself every revolution releasing one ball per exit 19 from each channel 16 that is within the rotating member(s), or disc, 11 per revolution (so long as the cam ring 18 is displaced in direction of arrow Z as shown in FIGS. 1 and 3).

FIG. 6 is a perspective view showing relationship of ball guide 12, linear elongate member, or rod, 15, and an aperture B which guides and supports the rod 15. A recess C shown in FIG. 6 provides the positional recess area for the ball guide 2 and the selector 13 at position A. The rotating member, or disc, 11 can be made from a lightweight composite material, as can ball guide 2 and elector 13.

A cover, not shown, is fitted onto disc 11. There is also provided, but not shown, a hopper type ball feeder magazine system with self contained vibration means to ensure constant ball feeding into center 110 of the rotating member, or disc, 11. The feeding system ensures that the correct amount of balls are fed into each ball track, or channel, 16—as is best shown in FIG. 6.

Once the cam ring 18 is actuated it will deliver an equal amount of balls from each exit area 19 of the rotating member, or disc, 11.

FIG. 6 shows the basic relationship of the major components that perform the sequenced projectile release operation. The selector 13 has to be, and is, cammed inwards towards the center 110 by the actuation of cam ring 18 as shown by directional arrow Z in FIG. 1. This camming action has a predetermined stroke as is best shown in FIG. 3. This predetermined stroke can be reduced substantially by a simple lever reduction system (not shown) which reduces the amount of G-Forces that would otherwise be exerted on the related parts and provide a more efficient and quicker releasing sequence.

Figure 7:
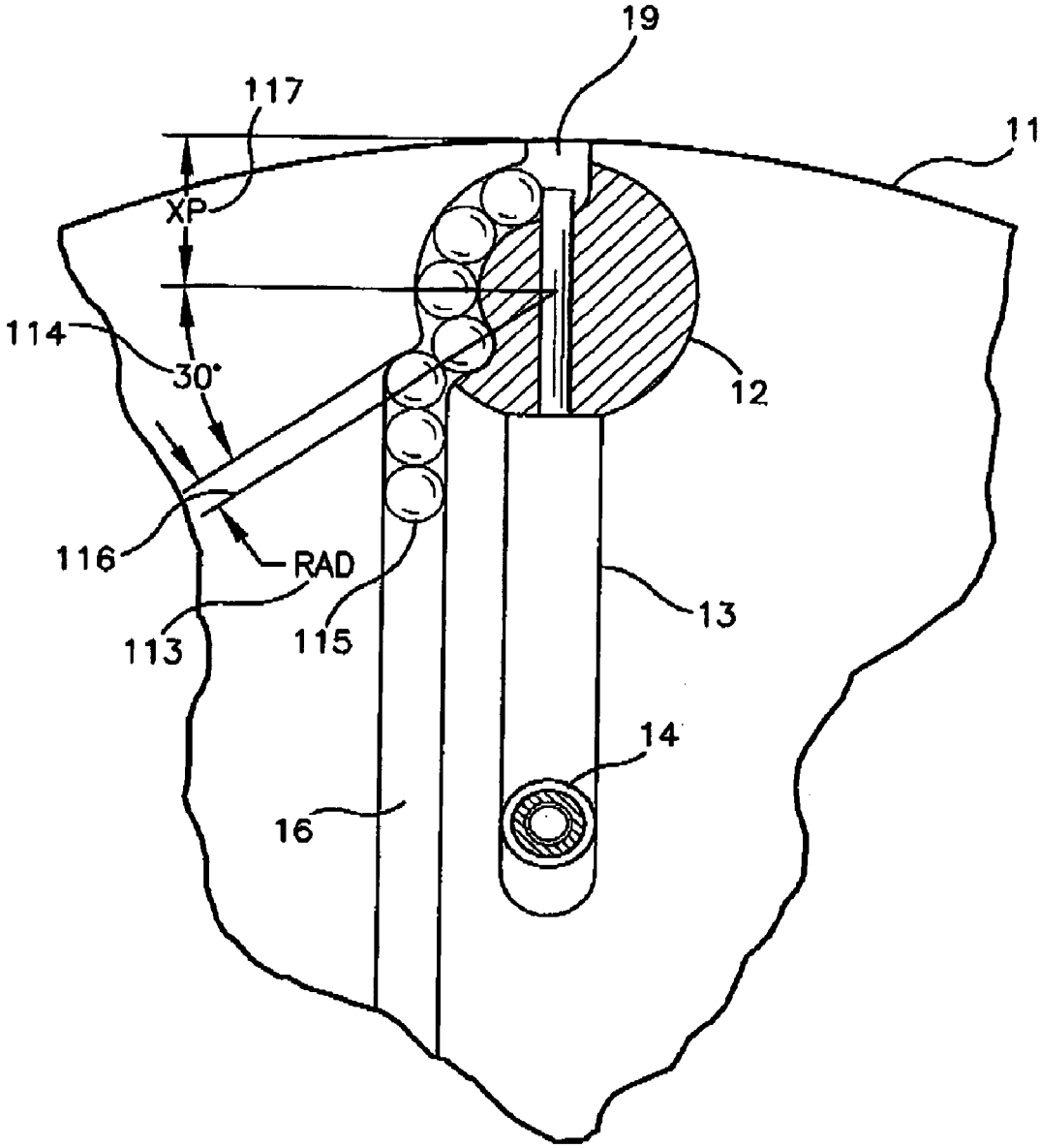
FIG. 7 is a plan view showing critical angular relationships of parts within the most preferred embodiment of the present invention.

Yet another important aspect of the present invention is the preferred design of (1) the rotating member, or disc, 11 and its faces and (2) its insert ball guides 12 as is best shown in FIGS. 3 and 6. These specially contoured features help the balls maintain a specific required timing during their respective movements. The curvatures ensure that the coaction of projectile balls and the parts of weapon 1 do not impede or otherwise effect the function and sequence timing, particularly the critical function of the elongate member, or rod, 15 and the entire projectile release mechanism of the present invention. Details of construction are shown in FIG. 7.

The various parts can readily be made from a number of different strong metal and plastic materials. FIG. 7 also shows the most preferred, critical, positions of all features as are interrelated and designed to work to work together in harmony at high speed. Together with the rotation of the rotating member (disc) 11, the exit X of the weapon 1 and the rotational direction of arrow Y and the generated centrifugal forces provide the release launch energy for the projectiles 2, 2' (shown in FIG. 1). An optional ring-shaped projectile provides aerodynamic capabilities not capable or available to conventional weapons using conventional powder propellant munitions.

A perspective view showing a drive motor 203, and a mechanism 200-204 by which a ring cam 18 may be displaced for enabling projectile ejection, is shown in FIG. 8. FIG. 8 shows the cam followers 14 the cam ring 18, a firing lever 200, sliders on the cam ring 201, a distance pin-cam ring 202, a motor 203, and a rotation pin-cam ring actuator 204. In light of previous explanation, the operation should be obvious.

Figure 9:
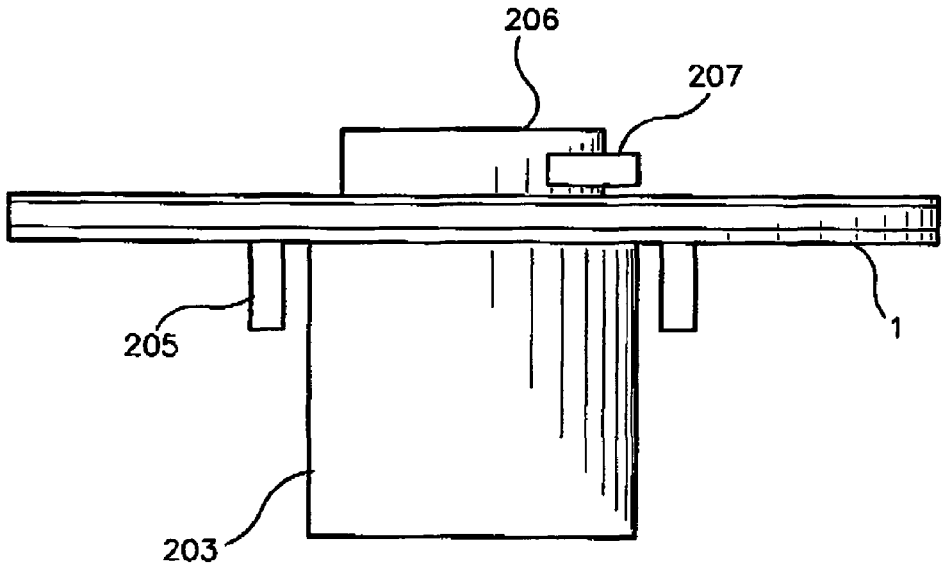
FIG. 9 is a side plan view of the mounting of a drive motor within the most preferred embodiment of a weapon in accordance with the present invention.

A side plan view of the preferred mounting of a drive motor 203 within the most preferred embodiment of a weapon in accordance with the present invention is shown in FIG. 9. Also shown in FIG. 9 are handles 205, a hopper 206 and an agitator 207.

3. DISCUSSION OF CAPABILITIES OF THE WEAPON

This invention together with its projectiles of potentially custom design is a quantum leap in small arms development. It is totally safe to the operator, does not draw return fire, and offers a silent and toxic-free system capable of safe continuous sustained fire without any jamming or the replacement of costly parts due to thermal wear common to all conventional weapon systems.

The weapon 1 is continuously operative over a broad range of rotational speeds. The rotational speed is, of course, determinate of both (1) the number of projectiles ejected per unit time, and (2) the ejection velocity of these projectiles. Rotational speed and force of the prime mover, or motor, 203 (shown in FIG. 8) may be varied in a range between (1) essentially zero, where but few projectiles infrequently dribble from the weapon with essentially zero ejection velocity, and (2) a high rate of speed where multiplicities of more than 10 projectiles each minute are ejected from the weapon at speeds greater than 100 feet per second. Thus both a velocity, and a rate, of projectile ejection from the weapon 1 are continuously variable with change in the rotational speed of the prime mover, or motor, 203.

Acceleration of the projectiles is gradual, and without appreciable shock of the projectile, or bullet, as is manifestly typical of firearms. If a projectile is to be "smart", and to contain computer and/or sensor electronics—as is manifestly permitted by projectiles ranging to one inch diameter in the weapon 1 of the present invention—=then the gradual projectile acceleration within the weapon 1 is high beneficial to not damaging these electronics while still maintaining full projectile speed and lethality.

In accordance with these and other possible variations and adaptations of the present invention, the scope of the invention should be determined in accordance with the following claims, only, and not solely in accordance with that embodiment within which the invention has been taught.

What is claimed is:

1. In a weapon for peripherally discharging projectiles under centrifugal force having a housing, or surround track, at least one member rotating within the housing, and at least one channel with a radial component within the at least one rotating member within which channel projectiles received near the center of rotation progress radially outwards until, escaping under centrifugal force at the periphery of the at least one rotating member, the projectiles are guided by the housing, or surround track, until finally being ejected from the weapon, an improvement to a projectile release mechanism for controlling passage of projectiles along the at least one channel, and thus an escape of the projectiles from the at least one rotating member, and thus the ejection of the projectiles from the weapon, the improved projectile release mechanism comprising:

an elongate member, substantially positioned along a radius line and within the at least one rotating member, having a distal end protruding within the at least one channel and a proximal end cam follower;

wherein the elongate member moves radially outward under centrifugal force of the rotation of the at least one rotating member until its distal end protrudes within the at least one channel, therein obstructing passage of projectiles along the channel and any escape of projectiles from the periphery of the at least one rotating member; and a ring cam, stationary to the housing and with its center displaced from a rotational axis of the at least one rotating member, having a cam surface that, when contacted during rotation by the cam follower of the elongate member, acts to pull the elongate member against centrifugal force radially inwards until the distal end of the elongate member ceases to protrude within the channel sufficiently so as to obstruct any passage of projectiles along the channel, therein permitting one or more projectiles to pass radially outwards in the at least one channel for subsequent escape from the at least one rotating member, and for subsequent ejection from the weapon.

2. The weapon in accordance with claim 1 wherein the cam surface of the ring cam acts on the cam follower of the elongate arm to gate passage of exactly one projectile within the channel of the at least one rotating member, and the escape and ejection of this one projectile, for each rotation of the rotating member of the weapon.

3. The weapon in accordance with claim 2 wherein a projectile escaping the at least one rotating member by action of the elongate member contacts the housing, of guide track, while also contacting and abutting a next projectile within the channel, making that the elongate arm may cycle to its inwards position without obstructing or frictional contact with any projectiles.

4. The weapon in accordance with claim 1 wherein the cam surface of the ring cam acts on the cam follower of the elongate arm to gate passage of a plurality of projectiles within the channel of the at least one rotating member, and the escape and ejection of these plurality of projectiles, for each rotation of the rotating member of the weapon.

5. The weapon in accordance with claim 1 wherein there are a plurality of rotating members each with an associated channel, and an elongate member associated with each channel of each rotating member, a cam follower of elongate member being acted upon in turn by a same cam surface of the ring cam so as to gate passage of one or more projectiles within the channel of the associated rotating member, and the escape and the ultimate ejection of these one or more projectiles, upon each rotation of the plurality of rotating members.

6. The weapon in accordance with claim 1 wherein the at least one rotating member and its associated channel, and its associated elongate member with its cam follower, and the ring cam, are all substantially in the same plane.

7. The weapon according to claim 1 further comprising:

an electric motor rotating the at least one rotating member.

8. The weapon according to claim 7 further comprising:

a control for the motor.

9. A method of gating a passage of projectiles within a channel within a rotating member of a weapon ejecting the projectiles by centrifugal force, the gating method directed to controlling the ejecting of the projectiles, the method comprising:

locating a sliding elongate member within a plane of the rotating member for sliding between (1) a first position obstructing any passage of projectiles within the channel under centrifugal force, and any subsequent ejection of projectiles so passed, and (2) a second position withdrawn from obstructing the channel of the rotating member, permitting projectiles to pass along the channel under centrifugal force and to subsequently be ejected from and by the weapon.

10. The method according to claim 9 wherein the sliding elongate member assumes its first position under centrifugal force.

11. The method according to claim 9 wherein the sliding elongate member assumes its second position under a camming force.

12. A weapon comprising:

a rotational variable speed prime mover imparting rotational force;

a member driven in rotation by the prime mover, the rotating member having at least one channel in which a projectile may move outwardly from a feed position near a center of rotation to an escape position at the periphery of the rotating member;

a housing, or track, for guiding projectiles escaping at the periphery of the rotating member so that the projectiles are ejected from the weapon at a predetermined exit point; and a projectile release mechanism controlling passage of projectiles within the at least one channel of the rotating member, and thus the escape of these projectiles from the periphery of the rotating member, and thus the ejection of these projectiles from the weapon;

wherein the projectile release mechanism is continuously so functional for controlling passage of the projectiles when the rotational speed and force of the prime mover is varied in a range between (1) essentially zero, where but few projectiles infrequently dribble from the weapon with essentially zero ejection velocity, and (2) a high rate of speed where multiplicities of more than 10 projectiles each minute are ejected from the weapon at speeds greater than 100 feet per second;

wherein both a velocity, and a rate, of projectile ejection from the weapon are continuously variable with change in the rotational speed of the prime mover.

13. The weapon according to claim 12 wherein the prime mover comprises: an electric motor.

14. The weapon according to claim 12 wherein the projectile release mechanism comprises:

an elongate member, substantially positioned along a radius line and within the at least one rotating member, having a distal end protruding within the at least one channel and a proximal end cam follower;

wherein the elongate member moves radially outward under centrifugal force of the rotation of the at least one rotating member until its distal end protrudes within the at least one channel, therein obstructing passage of projectiles along the channel and any escape of projectiles from the periphery of the at least one rotating member; and a ring cam, stationary to the housing and with its center displaced from a rotational axis of the at least one rotating member, having a cam surface that, when contacted during rotation by the cam follower of the elongate member, acts to pull the elongate member against centrifugal force radially inwards until the distal end of the elongate member ceases to protrude within the channel sufficiently so as to obstruct any passage of projectiles along the channel, therein permitting one or more projectiles to pass radially outwards in the at least one channel for subsequent escape from the at least one rotating member, and for subsequent ejection from the weapon.

* * * * *